US006224686B1

(12) United States Patent
Aoki et al.

(10) Patent No.: US 6,224,686 B1
(45) Date of Patent: May 1, 2001

(54) HIGH-STRENGTH VALVE SPRING AND IT'S MANUFACTURING METHOD

(75) Inventors: Toshinori Aoki, Toyoake; Masami Wakita, Nagoya; Takayuki Sakakibara, Okazaki, all of (JP)

(73) Assignee: Chuo Hatsujo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/256,300

(22) Filed: Feb. 24, 1999

(30) Foreign Application Priority Data

Feb. 27, 1998 (JP) ..... 10-064110
Feb. 27, 1998 (JP) ..... 10-064111

(51) Int. Cl.[7] ..... C21D 9/02; C22C 38/34; C22C 38/02

(52) U.S. Cl. ..... 148/230; 148/318; 148/333; 148/908; 148/580

(58) Field of Search ..... 148/908, 333, 148/318, 230, 580

(56) References Cited

U.S. PATENT DOCUMENTS 4,909,866 * 3/1990 Abe et al. ..... 148/908
5,665,179 * 9/1997 Izawa et al. ..... 148/908

FOREIGN PATENT DOCUMENTS 8-176730 7/1996 (JP) .
9-71843 3/1997 (JP) .
10-118930 5/1998 (JP) .
7188852A * 8/1998 (JP) .

* cited by examiner

*Primary Examiner*—Deborah Yee
(74) *Attorney, Agent, or Firm*—Oliff & Berridge, PLC

(57) ABSTRACT

The high-strength valve spring uses, as the material, a steel containing 0.5–0.8% C, 1.2–2.5 wt % Si, 0.4–0.8 wt % Mn, 0.7–1.0 wt % Cr, balance Fe and inevitable impurities, where, in the inevitable impurities, Al is no more than 0.005 wt % and Ti is no more than 0.005 wt %, and the largest non-metallic inclusion is 15 μm. In the oil tempering treatment, the heating temperature at hardening is between 950–1100° C., and nitriding treatment is performed after coiling. It is preferable to nitride at a temperature no lower than 480° C. Since the material is a high-silicon steel, the tempering temperature can be set at a higher temperature, and the nitriding temperature can be so high. In another way, after coiling, the spring is subjected to shot peening at least twice with shot particles of hardness 720 Hv or higher to produce a compressive residual stress of 85 kgf/mm$^2$ at around surface. These measures render high surface hardness, and produce high-strength valve springs having good fatigue strength, sag resistance and delayed fracture resistance.

22 Claims, 7 Drawing Sheets

供試材の化学組成（wt.%）

| | C | Si | Mn | Cr | V |
|---|---|---|---|---|---|
| 発明材 | 0.64 | 2.05 | 0.71 | 0.76 | 0.10 |
| 比較材 | 0.64 | 1.31 | 0.69 | 0.69 | 0.11 |

オイルテンパー線までの製造工程

オイルテンパー処理条件

| | 焼入れ | 焼戻し |
|---|---|---|
| 発明材 | 950℃（高周波加熱）<br>→加熱開始後15秒以内に冷却 | 420℃（高周波加熱）<br>→加熱開始後15秒以内に冷却 |
| 比較材 | 900℃（雰囲気加熱）<br>→ 10分保持後冷却 | 420℃（雰囲気加熱）<br>→ 5分保持後冷却 |

Fig. 4

オイルテンパー線の引張特性

| | 引張強さ ($N/mm^2$) | 絞り (%) |
|---|---|---|
| 発明材 | 2033 | 50.4 |
| 比較材 | 1989 | 48.8 |

Fig. 5

弁ばね諸元（寸法単位mm）

| 線径 | コイル径 | 総巻数 | 有効巻数 | 自由長 |
|---|---|---|---|---|
| φ3.2 | φ21.2 | 6.5 | 4.5 | 50 |

Fig. 6

窒化処理条件

| | |
|---|---|
| 発明材 | ① 450℃ × 120分<br>② 480℃ × 120分 |
| 比較材 | 420℃ × 120分 |

ショットピーニング条件

| | 1回目 | 2回目 |
|---|---|---|
| 発明材 | φ0.6mm, Hv720相当 | φ0.3mm, Hv720相当 |
| 比較材 | φ0.7mm, Hv580相当 | — |

熱間締め付け試験結果
(ショットピーニング材)

遅れ破壊試験結果
(ショットピーニング材)

HIGH-STRENGTH VALVE SPRING AND IT'S MANUFACTURING METHOD

The present invention relates to valve springs used mainly in an internal combustion engine of an automobile and having high fatigue resistance, high sag resistance and high delayed fracture resistance. It also relates to manufacturing methods of such valve springs.

BACKGROUND OF THE INVENTION

In the Japanese Industrial Standards (JIS), Oil-tempered Wire for Valve Springs (SWO-V: JIS G3561), Chromium-Vanadium Steel Oil-tempered Wire for Valve Springs (SWOCV-V: JIS G3565), and Silicon-Chromium Steel Oil-tempered Wire for Valve Springs (SWOSC-V: JIS G3566), etc. are specified as wires for valve springs of internal combustion engines. Among them, SWOSC-V has been mainly used because it has a higher fatigue resistance and higher sag resistance.

From the viewpoint of environmental protection and resource saving, cleanliness of the exhaust gas and fuel efficiency are always required on automobiles. Weight reduction of an automobile greatly contributes to those requirements, and thus weight reduction of automotive parts is always pursued.

Several new wires for valve springs have been proposed so far having high fatigue resistance and high sag resistance. In the Unexamined Publication No. H8-176730 of Japanese Patent Application, an oil-tempered wire for high-strength valve springs is proposed in its claim 1 as: using a steel including 0.5–0.8 wt % C, 1.2–2.5 wt % Si, 0.4–0.8 wt % Mn, 0.7–1.0 wt % Cr and inevitable impurities with iron balance, where Al content is no more than 0.005 wt % and Ti content is no more than 0.005 wt % in the inevitable impurities (claim 1). The steel is heated to a temperature in the range 950–1100° C., then quenched and tempered. In the Publication, oil-tempered wire including 0.05–0.15 wt % V (claim 2), and oil-tempered wire including, in addition to that, one or more among 0.05–0.5 wt % Mo, 0.05–0.15 wt % W and 0.05–0.15 wt % Nb (claim 3) are also proposed. In the Unexamined Publication No. H971843 of Japanese Patent Application by the same applicant, a high toughness oil-tempered wire for valve springs is proposed as using the same steel as above and the residual austenite ($\gamma$) after quenching and tempering is suppressed to 1–5 vol % (claims 1 and 2). In the Publication, another oil-tempered wire is proposed whose microscopic structure is required to be so that the density of carbide particles no smaller than 0.05 $\mu$m in its diameter is no more than five pieces/ $\mu m^2$ in the microscopic photograph (claims 3 and 4). Combination of these are proposed in claims 5 and 6. The manufacturing method is disclosed as follows. In case of claims 1, 2, 5 and 6, the heating speed in tempering is no smaller than 150° C./sec and the maximum heating temperature in tempering is within 450–600° C. The time period from the beginning of heating to the beginning of cooling by water or the like is no longer than 15 sec. In case of claims 3, 4, 5 and 6, the heating speed in hardening is no smaller than 150° C./sec, and the maximum heating temperature in hardening is no higher than 1100° C. but no lower than the temperature T(° C.) calculated as T=500+750·C (Carbon) +500·V (Vanadium). The time period from the beginning of heating to the beginning of cooling by water or oil is no longer than 15 sec.

Most of the measures proposed so far are about the material steels or, at most, about wires (oil-tempered wires), but no measure has been taken to the stage of manufacturing the final product, that is the valve spring, in order to endow high fatigue strength and high sag resistance. If the spring manufacturing process is inadequate, even the best material cannot make a good valve spring, and such an inadequate process may make it difficult to manufacture an appropriate valve spring, and may further, in some cases, deteriorate its fatigue strength or sag resistance.

The present invention addresses such problems, and one of the objects is to provide a valve spring having an improved fatigue strength from conventional ones by choosing the best material and then by applying an appropriate manufacturing process suitable to the material chosen. In concrete, the present invention provides a valve spring having the durability of more than $5\times10^7$ times under the repeated stress of $\tau$=60 ±51 kgf/mm$^2$ in its maximum shear stress at the wire. In the present invention, the delayed fracture is also taken into consideration and its durability is addressed.

Another object of the present invention is to provide a valve spring having a lesser sag while possessing no less fatigue strength by choosing the best material and then by applying an appropriate manufacturing process suitable to the material chosen. In concrete, the present invention provides a valve spring yielding the residual shear strain $\gamma$ of less than $5\times10^{-4}$ when left 48 hours at the temperature of 120° C. with the maximum shear stress of $\tau$=90 kgf/mm$^2$ in the wire surface. In the present invention, the delayed fracture is also taken into consideration and its durability is addressed.

SUMMARY OF THE INVENTION

The first one of the high-strength valve springs of the present invention corresponding to the above described first object is characterized in that it:

i) uses, as the material, a steel containing 0.5–0.8 wt % C, 1.2–2.5 wt % Si, 0.4–0.8 wt % Mn, 0.7–1.0 wt % Cr, balance Fe and inevitable impurities, where, in the inevitable impurities, Al is no more than 0.005 wt % and Ti is no more than 0.005 wt %, and the largest non-metallic inclusion is 15 $\mu$m;

ii) uses, as the wire, an oil-tempered wire subjected to hardening and tempering with the heating temperature for hardening between 950–1100° C.; and iii) is coiled, followed by a nitriding treatment.

The material steel described in i) may further contain one or more of: 0.05–0.15 wt % V, 0.05–0.5 wt % Mo, 0.05–0.15 wt % W, and 0.05–0.15 wt % Nb.

It is preferred that the oil-tempered wire described in ii) contains 1–5 vol % residual austenite after hardening and tempering.

It is also preferred that, in the microscopic structure of the oil-tempered wire described in ii), the density of carbides larger than 0.05 $\mu$m in diameter is no more than 5 pieces/ $\mu m^2$ in the microscopic photograph.

The nitriding treatment described in iii) may be done at the same temperature as that used in conventional valve springs. Valve springs of higher strength can be obtained in the present invention by setting the temperature at no lower than 480° C., and making the surface hardness no lower than 900 Hv.

In the first high-strength valve spring of the present invention, the silicon content of the material steel is set at 1.2–2.5% which is higher than the conventional Silicon Chromium Oil-tempered Wire for Valve Springs (SWOSC- V). Silicon dissolves in ferrite and martensite, strengthens them, and retards the decomposition of the martensite phase into [ferrite+carbides] in tempering. That is, it shifts the phase decomposition temperature to a higher temperature in tempering, which allows raising the tempering temperature to obtain the same tensile strength. The rise in the tempering temperature promotes recovery of dislocations and stabilizes the microscopic structure. This suppresses initiation of fatigue cracks, which increases the time fatigue strength and boosts the fatigue limit. Further it improves the delayed fracture strength.

The rise in the tempering temperature hampers the change in the microscopic structure when the temperature of the valve spring rises in use. This impedes the movement of dislocations, and contributes to the improvement of sag resistance.

It is well known that it is easier for nitrogen atoms to enter into steel at higher nitriding temperature, and a higher surface hardness is obtained thereby. When, however, the nitriding temperature exceeds the tempering temperature in the oil tempering treatment, the hardness of the inner part of the wire decreases, and the fatigue strength and sag resistance are deteriorated. Thus it is conventionally believed that it is impossible to raise the nitriding temperature. In the present invention, however, the tempering temperature can be raised as described above owing to the strengthening effect of silicon. Accordingly, the nitriding temperature can also be raised, which makes it possible to increase the surface hardness, or the fatigue strength. This also contributes to the improvement of the sag resistance.

Based on the above considerations, the first valve spring of the present invention adopts the oil-tempered wire proposed in the Unexamined Publication Nos. H8-176730 and H9-71843 described before. The reason of the requirements to the chemical compositions and the microscopic structure by the present invention is reproduced from the publications as follows.

C: 0.5–0.8 wt %

C is indispensable to strengthening a steel wire, but an adequate strength cannot be obtained with less than 0.5%. But C exceeding 0.8% deteriorates the toughness, and the steel wire becomes more susceptible to flaws, making it less reliable.

Si: 1.2–2.5 wt %

Si increases the strength of ferrite and martensite, as described above, and improves sag resistance. The effect is inadequate with less than 1.2% Si. But Si exceeding 2.5% lowers the cold forming capability, and promotes decarburization in hot forming or in heat treatment.

Mn: 0.4–0.8 wt %

Mn enhances hardenability of steels, and fixes S content in steels, preventing its horn. Less than 0.4% Mn has no such effect, but more than 0.8% Mn lowers the toughness.

Cr: 0.7–1.0 wt %

Cr, similarly to Mn, enhances hardenability of steels. And Cr endows toughness to wire in the patenting treatment after hot rolling. It also enhances resistance to softening in tempering and increases the strength. Less than 0.7% Cr has an inadequate effect, but more than 1.0% Cr suppresses the carbide solution, leading to lower strength and excessive hardenability with less toughness.

V: 0.05–0.15 wt %

V forms carbides in tempering, which enhances resistance to softening. Less than 0.05% V is inadequate for such effect, but more than 0.15% V produces excessive amount of carbides in the heating of hardening, which deteriorates toughness.

Mo: 0.05–0.5 wt %

Mo forms carbides in tempering, which enhances resistance to softening. Less than 0.05% Mo is inadequate for such effect, but more than 0.5% Mo produces excessive amount of carbides in the heating of hardening, which deteriorates toughness.

Nb: 0.05–0.15 wt %

Nb forms carbides in tempering, which enhances resistance to softening. Less than 0.05% Nb is inadequate for such effect, but more than 0.15% Nb produces excessive amount of carbides in the heating of hardening, which deteriorates toughness.

Al, Ti: no more than 0.005 wt %

They form high-melting-point non-metallic inclusions $Al_2O_3$ or TiO. The non-metallic inclusions are hard so that, when exist just under the surface of a wire, they lower the fatigue strength much. Thus the content of these elements are required to be no more than 0.005%, though inevitable impurities they are. It is preferred to use materials including lower amount of those elements.

Heating temperature in hardening: 950–1100° C.

The heating temperature determines the soluble amount of V or other elements in hardening, and the soluble amount is larger when the heating temperature is higher. When the heating temperature is lower than 950° C., the soluble amount of V or other elements are so small that a lot of carbides precipitate. Since, at 1100° C., most of V, W and Nb specified in the present invention is thought to dissolve in Fe, no improvement in toughness or no increase in resistance to softening can be expected at temperatures higher than 1100° C.

Nitriding treatment: no lower than 480° C. and surface hardness no lower than 900 Hv Because the nitriding treatment is done after the oil tempering treatment, the nitriding temperature cannot exceed the tempering temperature at the oil tempering treatment. In conventional oil-tempered wires, the tempering temperatures were under 450° C. at most, and, accordingly, the nitriding treatment is done below that temperature. Since, as described before, the high-strength valve spring according to the present invention uses high-silicon steel as its material, the tempering temperature in the oil tempering treatment can be raised to a higher temperature, so that the nitriding treatment can be done at as high as 480° C. or higher.

Generally, every chemical reaction is activated as the temperature is raised. In the case of nitriding treatment, nitrogen (N) atoms become easier to enter steel as the temperature is raised, by which the spring surface is further hardened. At temperatures under 480° C., the surface hardness does not reach the object value. Also, the object fatigue strength cannot be obtained with the surface hardness of under 900 Hv.

Residual austenite (γ): 1–5 vol %

The residual austenite phase in the tempered martensite increases the toughness of the steel. The effect is negligible when the volume percentage is less than 1%, but, while in use, the residual austenite transforms to martensite when the volume percentage exceeds 5%, which renders sag.

Density of carbide particles larger than 0.05 μm in diameter: no more than 5 pieces/$\mu m^2$ Carbide particles larger than 0.05 μm in diameter may generate cracks in the microscopic structure in forming a valve spring or in other manufacturing stages. If the density in the microscopic structure exceeds 5 pieces/ $\mu m^2$, the toughness remarkably deteriorates.

It is preferable to satisfy the requirement to the amount of residual austenite and the requirement to the amount of carbide particles using the following heat treatment.

As for the heating for hardening in the hardening/tempering process, the heating speed is no smaller than 150° C./sec. The heating temperature is no higher than 1100° C. but no lower than T(° C.)=500+750·C+500 V or no lower than 950° C. whichever higher. The time period from the beginning of heating to the beginning of cooling by water or oil is no longer than 15 sec.

If the time period is longer than 15 sec, the crystal grains coarsen and the toughness deteriorates. If the heating speed is no more than 150° C./sec the carbides are not adequately dissolved in the 15 seconds until the beginning of cooling. If the heating temperature is higher than 1100° C. or higher, toughness deteriorates due to grain coarsening and decarburization occurs. If, on the contrary, the heating temperature is the temperature T(° C.)=500+750 C +500 ·V or lower, the carbides are not adequately dissolved.

As for the heating for tempering in the hardening/tempering process: the heating speed is no smaller than 150° C./sec; the heating temperature is 450–600° C.; and the time period from the beginning of heating to the beginning of cooling by water or other coolant is no longer than 15 sec.

If the heating speed is smaller than 150° C./sec or the time period until cooling is longer than 15 sec, the residual austenite phase diminishes to less than 1 vol %.

It can be summarized that, in the first high-strength valve spring of the present invention, the silicon content of the material steel is increased to obtain the solution strengthening effect to the ferrite and martensite and to obtain the effect of retarding decomposition of the martensite phase to [ferrite+carbides]. That is, the phase decomposing temperature is shifted to a higher temperature in the oil tempering treatment, by which the recovery of dislocations is promoted and the microscopic structure is stabilized. The rise in the tempering temperature enables high-temperature nitriding, which can increase the surface hardness. Owing to these effects, the fatigue strength is improved. The rise in the tempering temperature, on the other hand, prevents changes in the microscopic structure due to the temperature rise while in use of the valve springs, and impedes movement of dislocations, which greatly contribute to the improvement of sag resistance. To an oil-tempered wire having such characteristics, in the present invention, an appropriate nitriding treatment is applied so that high-strength valve spring is manufactured taking the most of such characteristic.

The second one of the high-strength valve springs of the present invention corresponding to the above described second object is characterized in that it:

i) uses, as the material, a steel containing 0.5–0.8 wt % C, 1.2–2.5 wt % Si, 0.4–0.8 wt % Mn, 0.7–1.0 wt % Cr, balance Fe and inevitable impurities, where, in the inevitable impurities, Al is no more than 0.005 wt % and Ti is no more than 0.005 wt %, and the largest non-metallic inclusion is 15 $\mu$m;

ii) uses, as the wire, an oil-tempered wire subjected to hardening and tempering with the heating temperature for hardening between 950–1100° C.; and iii) is coiled, followed by a shot peening treatment using high-hardness shot particles.

The material steel described in i) may further contain one or more of: 0.05–0.15%, V, 0.05–0.5% Mo, 0.05–0.15% W, and 0.05–0.15% Nb.

It is preferred that the oil-tempered wire described in ii) contains 1–5 vol % residual austenite after hardening and tempering.

It is also preferred that, in the microscopic structure of the oil-tempered wire described in ii), the density of carbides 0.05 $\mu$m or larger in diameter is no more than 5 pieces/ $\mu m^2$ in the microscopic photograph.

The hardness of the high-hardness shot particles described in iii) is no lower than 600 Hv, and it is preferable to be no lower than 720 Hv.

The shot peening treatment may be performed just once. When the shot peening treatment is performed twice or more so that the compressive residual stress around the surface is no less than 85 kgf/mm$^2$, the fatigue strength is further improved.

The second high-strength valve spring of the present invention uses the same material steel as that of the first high-strength valve spring described above. Thus the requirements to the chemical compositions and microscopic structure are almost the same as describe above for the first high-strength valve spring, except that the nitriding treatment is replaced by the following shot peening treatment.

Shot peening: using shot particles of hardness no lower than 600 Hv

A shot peening treatment endows compressive residual stress on the surface of a valve spring, which effectively reduces the maximum shear stress working on the surface of the valve spring in use and improves the fatigue strength remarkably. Enough improvements have been made so far so that the current level of compressive residual stress of a conventional valve spring has almost reached to its maximum value, and no greater residual stress was able to obtain even when the hardness of the shot particles is increased or the shot peening treatment is done twice or more. Since, as described above, the high-strength valve spring of the present invention uses a high-silicon steel material, the tempering temperature can be set higher to obtain the same hardness, whereby the microscopic structure is more stable than conventional ones. This enables using shot particles of higher hardness than conventional ones, i.e., no lower than 600 Hv, which renders greater compressive residual stress.

Instead of raising the tempering temperature taking advantage of the strengthening effect of silicon, it is possible to lower the tempering temperature a little and use the valve spring at higher hardness than conventional ones. This improves the fatigue strength and sag resistance. It may also be possible to increase the compressive residual stress of the surface and further improve the fatigue strength by applying a shot peening treatment with shot particles having higher hardness than conventional ones. When the hardness of the material is raised, shot particles of higher hardness, i.e., no lower than 720 Hv, may be used to obtain an adequate compressive residual stress.

In any case above, a higher compressive residual stress can be obtained by applying the shot peening treatment twice or more and higher fatigue strength can be obtained. Specifically, it is preferable to set the residual stress at around surface to be no less than 85 kgf/mm$^2$. The multiple shot peening treatments are also effective to prevent delayed fracture from surface.

BRIEF DESCRIPTION OF THE DRAWINGS

FIG. 4 Tensile characteristics of an oil-tempered wire

FIG. 5 Dimensions of a valve spring

FIG. 6 Nitriding condition

EMBODIMENTS

Figures 1, 2, 3:
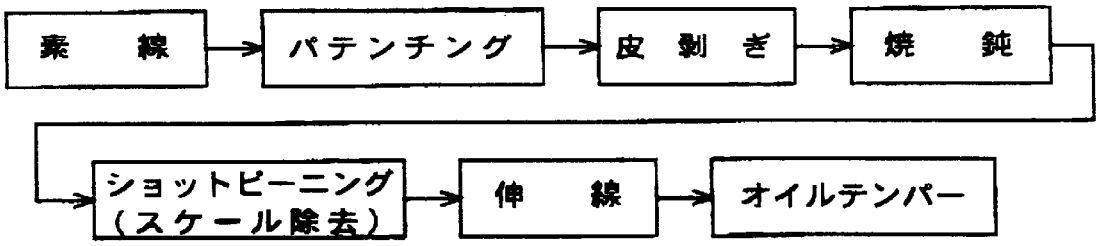
FIG. 1 Chemical compositions of tested materials
FIG. 2 Manufacturing process of an oil-tempered wire
FIG. 3 Oil tempering conditions

The characteristics of the high-strength valve spring of the present invention is explained based on experiments using a comparative steel which is a conventionally widely used Silicon-Chromium Oil-tempered Wire (SWOSC-V) plus a small amount of vanadium. The chemical compositions of the inventive sample and the comparative sample are shown in FIG. 1.

Both samples are produced in a vacuum melting furnace, and hot forged and hot rolled to form into a 6.5 mm diameter crude wire. The crude wire is processed as shown in FIG. 2 to make a 3.2 mm diameter oil-tempered wire. The conditions for the oil-tempering treatment differ depending on the samples, which are shown in FIG. 3. The tensile strength and reduction of area of the oil-tempered wires are shown in FIG. 4.

From the oil-tempered wire thus obtained, two types of test samples of valve springs having dimensions shown in FIG. 5 are formed.

Figure 7:
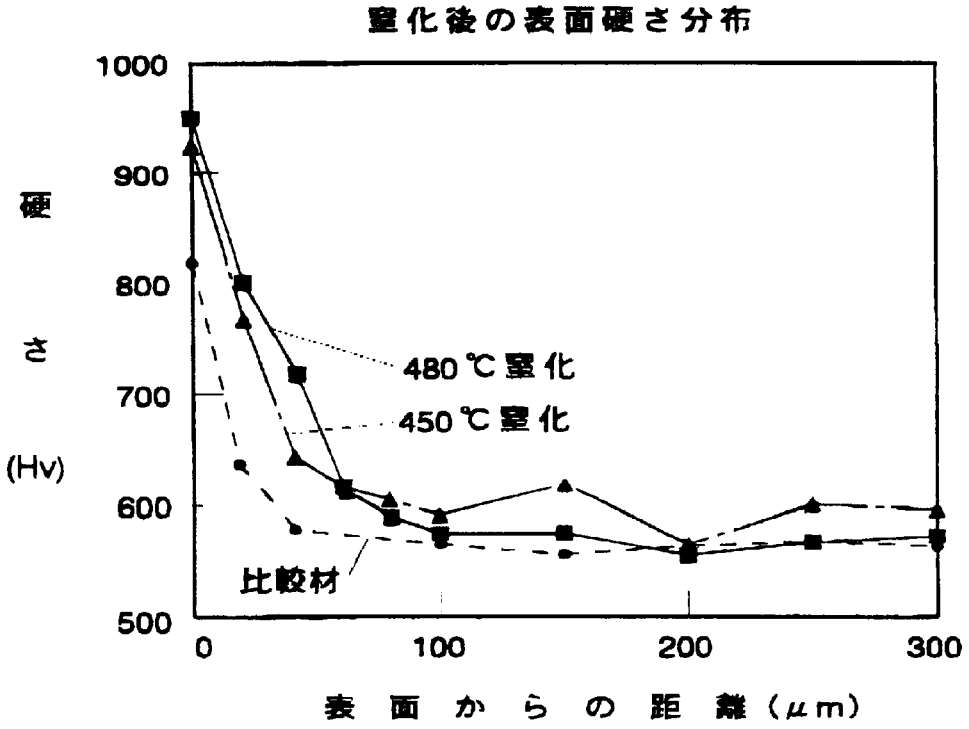
FIG. 7 Hardness distribution around surface after nitriding treatment

The first type of valve springs underwent nitriding treatments as shown in FIG. 6. For the inventive samples, the nitriding temperature is set at 450° C. which is the same as conventional ones and at 480° C. which is higher than that. As shown in FIG. 7, the surface hardness rises and hardening depth increases at higher nitriding temperature. Though the internal hardness decreases due to high nitriding temperature, the internal hardness and the hardening depth of the 480° C.-nitrided sample are almost equal to that of normally nitriding comparative sample. Thus it is possible in the present invention to increase the surface hardness while maintaining the internal hardness. The inventive sample is expected to have higher stability than conventional ones with respect to the sag resistance because the nitriding temperature is higher than conventional ones. The characteristic will be discussed later.

After the nitriding treatment, the springs are shot peened by the same method as the conventional one to make them the same as actually used.

Figure 8:
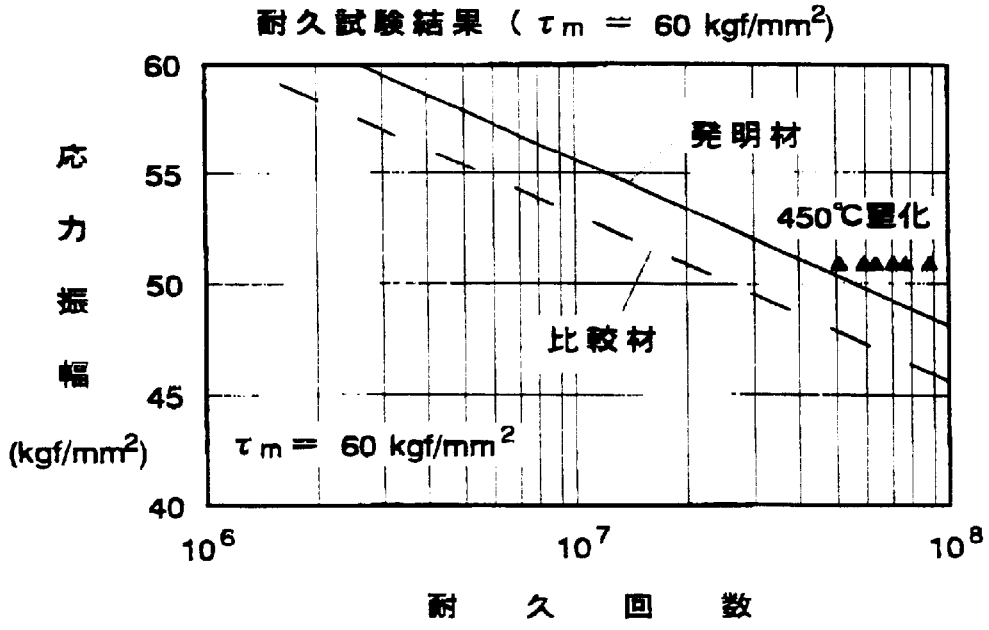
FIG. 8 Fatigue test results ($\tau$0=60 kgf/mm)
Figure 9:
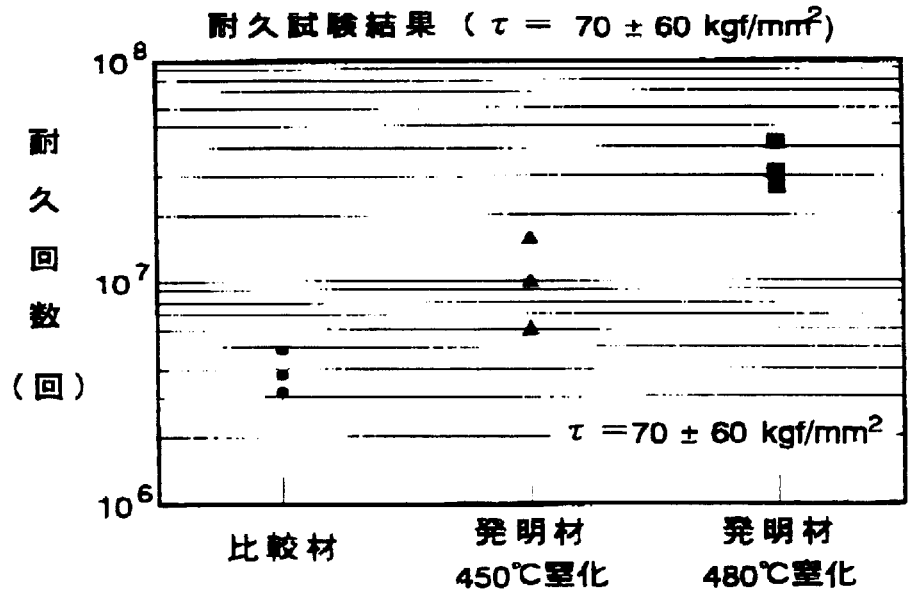
FIG. 9 Fatigue test results ( $\tau$=70±60 kgf/mm$^2$)
Figure 10:
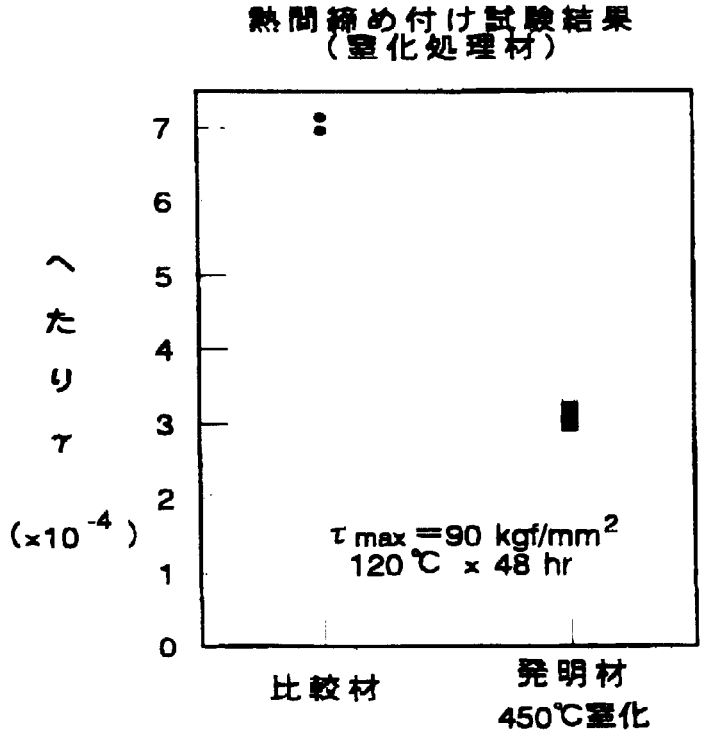
FIG. 10 Hot setting test results Nitrided samples)

The results of fatigue strength test, sag resistance test and delayed fracture strength test for the first valve springs are shown in FIGS. 8–10.

FIG. 8 is the graph of number of loading cycles until the 450° C.-nitrided inventive valve springs break when repeatedly loaded to yield $\tau$=60±51 kgf/mm$^2$ shear stress at the wire surface. As shown in FIG. 8, even the 450° C.-nitrided inventive samples have higher fatigue strength than comparative ones, and the object of the present invention, i.e., B10 life (the number of loading cycles at which 10% of the tested samples break) is longer than $5\times10^7$ at $\tau$=60±51 kgf/mm$^2$.

When tested at higher stress $\tau$=70±60 kgf/mm$^2$, the inventive samples have higher fatigue strength at any nitriding temperature than comparative ones as shown in FIG. 9. The B10 life of the 480° C.-nitrided inventive sample is longer than $2.5\times10^7$, which proves that the inventive valve springs are well applicable to actual use under such high loading condition.

FIG. 10 is a graph of residual shear strain $\gamma$after samples are loaded to yield the maximum shear strain $\tau$=90 kgf/mm$^2$ at the surface and left 48 hours at 120° C. The inventive samples have far better sag resistance than comparative ones.

Figure 11:
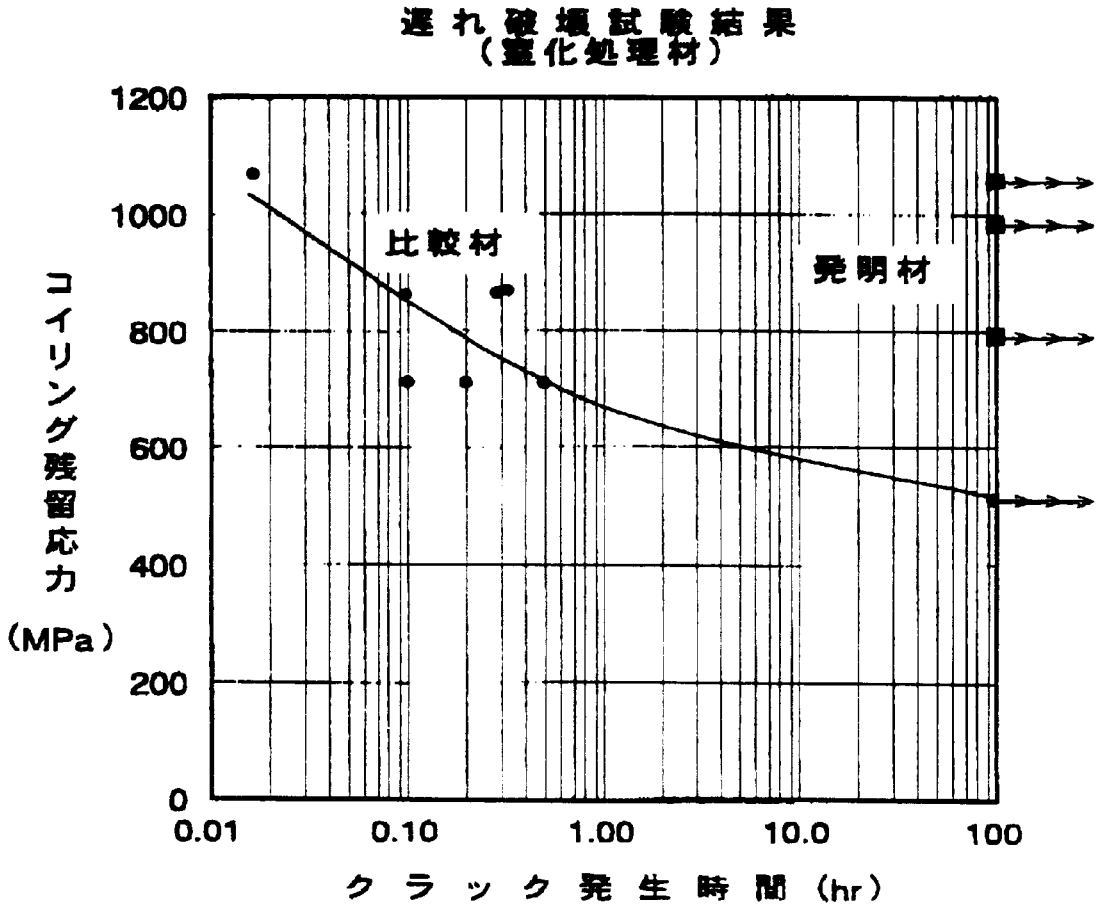
FIG. 11 Delayed fracture test results (Nitrided samples)

FIG. 11 is a graph of a delayed fracture test. Various residual stresses are produced after coiling, and the time period until a crack initiates at every residual stress is measured. The inventive samples have a much longer crack initiation time period than comparative ones.

Figures 12, 13:
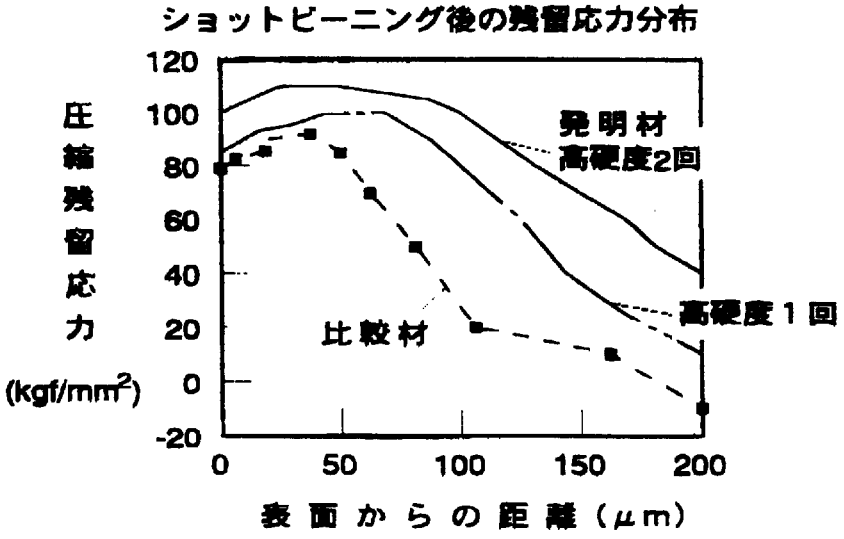
FIG. 12 Shot peening condition
FIG. 13 Residual stress distribution after shot peening

The second valve springs are shot peened under the conditions shown in FIG. 12. Since, as shown in FIG. 4, the inventive samples have higher hardness after heat treatment than conventional ones, shot particles of accordingly higher hardness are used. The residual stress distribution at around surface after shot peening is shown in FIG. 13. The inventive samples have larger compressive residual stress than comparative samples even after the first shot peening treatment, and the compressive residual stress further increases after the second shot peening treatment, which fully satisfies the condition that it is larger than 85 kgf/mm$^2$.

Figure 14:
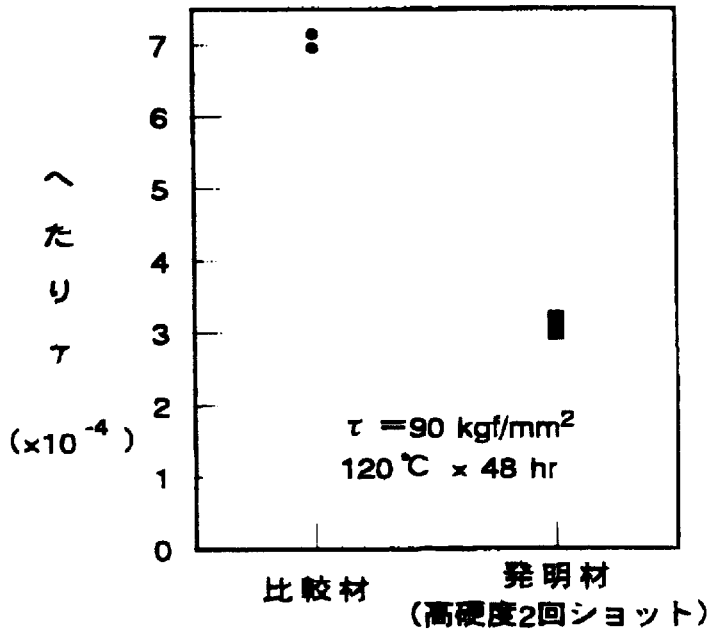
FIG. 14 Hot setting test results (Shot peened samples)
Figure 15:
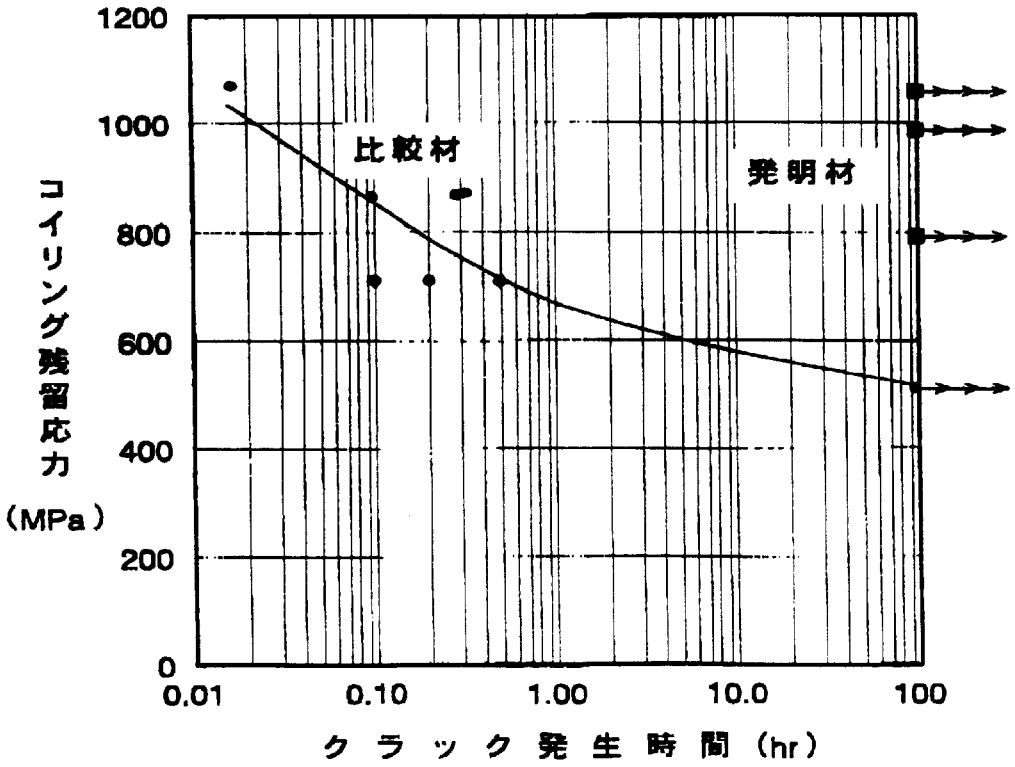
FIG. 15 Delayed fracture test results (Shot peened samples)

The results of sag resistance test and delayed fracture strength tests on the springs thus manufactured are shown in FIGS. 14 and 15.

FIG. 14 is a graph of residual shear strain $\gamma$ after samples are loaded to yield the maximum shear strain $\tau$=90 kgf/mm$^2$ at the surface and left 48 hours at 120° C. The inventive samples have much better sag resistance than comparative ones, and satisfy the condition that the residual shear strain $\gamma<5\times10^{-4}$.

FIG. 15 is a graph of a delayed fracture test. Various residual stresses are produced after coiling, and the time period until a crack initiates at every residual stress is measured. The inventive samples have much longer crack initiation time period than comparative ones.

What is claimed is:

1. A high-strength valve spring formed by subjecting an oil-tempered steel wire made from a steel material composition containing 0.5–0.8 wt % C, 1.2–2.5 wt % Si, 0.4–0.8 wt % Mn, 0.7–1.0 wt % Cr, balance Fe and inevitable impurities, where, in the inevitable impurities, Al is no more than 0.005 wt % and Ti is no more than 0.005 wt %, and the largest non-metallic inclusion is 15 $\mu$m, to hardening treatment at a heating temperature between 950–1100° C. followed by cooling; tempering treatment followed by cooling; coiling; and nitriding, wherein the oil-tempered wire comprises 1–5 vol % residual austenite after hardening and tempering and the density of carbides larger than 0.05 $\mu$m in diameter is no more than 5 pieces/$\mu$m$^2$ in the microscopic photograph of the oil-tempered wire.

2. The high-strength valve spring according to claim 1, wherein the material steel further comprises one or more of: 0.05–0.15 wt % V, 0.05–0.5 wt % Mo, 0.05–0.15 wt % W, and 0.05–0.15 wt % Nb.

3. The high-strength valve spring according to claim 1, wherein the nitriding treatment is performed at a temperature no lower than 480° C. to make the surface hardness no lower than 900 Hv.

4. A method of manufacturing a high-strength valve spring, comprising: subjecting an oil-tempered steel wire made from a steel material composition containing 0.5–0.8 wt % C, 1.2–2.5 wt % Si, 0.4–0.8 wt % Mn, 0.7–1.0 wt % Cr, balance Fe and inevitable impurities, where, in the inevitable impurities, Al is no more than 0.005 wt % and Ti is no more than 0.005 wt %, and the largest non-metallic inclusion is 15 μm, to hardening treatment at a heating temperature between 950–1100° C. followed by cooling; tempering treatment followed by cooling; coiling; and nitriding.

5. The high-strength valve spring manufacturing method according to claim 4, wherein the material steel further comprises one or more of: 0.05–0.15 wt % V, 0.05–0.5 wt % Mo, 0.05–0.15 wt % W, and 0.05–0.15 wt % Nb.

6. The high-strength valve spring manufacturing method according to claim 4, wherein in the hardening heat treatment: the heating speed is no smaller than 150° C./sec; the heating temperature is no higher than 1100° C. but no lower than the temperature T(° C.)=500 +750·C (Carbon %)+500·V (Vanadium %), or no lower than 950° C., whichever higher; and the time period from the beginning of heating to the beginning of cooling by water or oil is no longer than 15 sec.

7. The high-strength valve spring manufacturing method according to claim 4, wherein in the tempering heat treatment: the heating speed is no smaller than 150° C./sec; the heating temperature is 450–600° C.; and the time period from the beginning of heating to the beginning of cooling by water or other coolant is no longer than 15 sec.

8. The high-strength valve spring manufacturing method according to claim 4, wherein the nitriding treatment is performed at a temperature no lower than 480° C. to make the surface hardness no lower than 900 Hv.

9. A high-strength valve spring formed by subjecting an oil-tempered steel wire made from a steel material composition containing 0.5–0.8 wt % C, 1.2–2.5 wt % Si, 0.4–0.8 wt % Mn, 0.7–1.0 wt % Cr, balance Fe and inevitable impurities, where, in the inevitable impurities, Al is no more than 0.005 wt % and Ti is no more than 0.005 wt %, and the largest non-metallic inclusion is 15 μm, to hardening treatment at a heating temperature between 950–1100° C. followed by cooling; tempering treatment followed by cooling; coiling; and shot peening using high-hardness shot particles, wherein the oil-tempered wire comprises 1–5 vol % residual austenite after hardening and tempering and the density of carbides larger than 0.05 μm in diameter is no more than 5 pieces/$\mu m^2$ in the microscopic photograph of the oil-tempered wire.

10. The high-strength valve spring according to claim 9, wherein the material steel further comprises one or more of: 0.05–0.15% V, 0.05–0.5% Mo, 0.05–0.15% W, and 0.050.15% Nb.

11. The high-strength valve spring according to claim 9, wherein the hardness of the high-hardness shot particles is no lower than 600 Hv.

12. The high-strength valve spring according to claim 9, wherein the hardness of the high-hardness shot particles is no lower than 720 Hv.

13. The high-strength valve spring according to claim 11, wherein the shot peening treatment is performed at least twice so that the compressive residual stress around the surface is no less than 85 kgf/$mm^2$.

14. The high-strength valve spring according to claim 12; wherein the shot peening treatment is performed at least twice so that the compressive residual stress around the surface is no less than 85 kgf/ $mn^2$.

15. A method of manufacturing a high-strength valve spring, comprising: subjecting an oil-tempered steel wire made from a steel material composition containing 0.5–0.8 wt % C, 1.2–2.5 wt % Si, 0.4–0.8 wt % Mn, 0.7–1.0 wt % Cr, balance Fe and inevitable impurities, where, in the inevitable impurities, Al is no more than 0.005 wt % and Ti is no more than 0.005 wt %, and the largest non-metallic inclusion is 15 μm, to hardening treatment at a heating temperature between 950–1100° C. followed by cooling: tempering treatment followed by cooling; coiling; and shot peening using high-hardness shot particles.

16. The high-strength valve spring manufacturing method according to claim 15, wherein the material steel further comprises one or more of: 0.05–0.15% V, 0.05–0.5% Mo, 0.05–0.15% W, and 0.05–0.15% Nb.

17. The high-strength valve spring manufacturing method according to claim 15, wherein, in the hardening heat treatment: the heating speed is no smaller than 150° C./sec; the heating temperature is no higher than 1100° C. but no lower than T(° C.)=500+750·C(carbon %) +500·V (vanadium %) or no lower than 950° C. whichever higher; and the time period from the beginning of heating to the beginning of cooling by water or oil is no longer than 15 sec.

18. The high-strength valve spring manufacturing method according to claim 15, wherein, in the tempering heat treatment: the heating speed is no smaller than 150° C./sec; the heating temperature is 450–600° C.; and the time period from the beginning of heating to the beginning of cooling by a coolant such as water is no longer than 15 sec.

19. The high-strength valve spring manufacturing method according to claim 15, wherein the shot peening is performed with shot particles having hardness no lower than 600 Hv.

20. The high-strength valve spring manufacturing method according to claim 15, wherein the shot peening is performed with shot particles having hardness no lower than 720 Hv.

21. The high-strength valve spring manufacturing method according to claim 19, wherein the shot peening is performed at least twice.

22. The high-strength valve spring manufacturing method according to claim 20, wherein the shot peening is performed at least twice.

* * * * *

UNITED STATES PATENT AND TRADEMARK OFFICE

CERTIFICATE OF CORRECTION

PATENT NO. : 6,224,686 B1
DATED : May 1, 2001
INVENTOR(S) : Toshinori Aoki et al.

It is certified that error appears in the above-identified patent and that said Letters Patent is hereby corrected as shown below:

Title page,
Item [54], change "IT'S" to -- ITS --

Please replace the Figs. 1-15 in the pantent with the attached seven sheets of formal drawings of Figs. 1-15.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*